United States Patent [19]

Matsuno et al.

[11] Patent Number: 5,039,086

[45] Date of Patent: Aug. 13, 1991

[54] METHOD AND APPARATUS FOR ADJUSTING POSTURE OF SHEETS

[75] Inventors: Junichi Matsuno, Toride; Tsuyoshi Ogasawara, Ibaraki; Masataka Kawauchi, Ishioka; Tsuneki Kobayashi, Mito; Yasuyuki Tsuji, Katsuta, all of Japan

[73] Assignees: Hitachi, Ltd.; Hitachi Koki, Ltd., both of Tokyo, Japan

[21] Appl. No.: 395,015

[22] Filed: Aug. 17, 1989

[30] Foreign Application Priority Data

Sep. 2, 1988 [JP] Japan ..... 63-218345

[51] Int. Cl.[5] ..... B65H 7/02

[52] U.S. Cl. ..... 271/227; 271/243; 271/245; 271/251

[58] Field of Search ..... 271/243, 227, 230, 236, 271/245, 251, 250

[56] References Cited

U.S. PATENT DOCUMENTS

| | | | |
|---|---|---|---|
| 2,039,784 | 5/1936 | Eckhard . | |
| 4,147,339 | 4/1979 | Shiina | 271/251 X |
| 4,685,664 | 8/1987 | Petersdorf | 271/227 |

FOREIGN PATENT DOCUMENTS

| | | | |
|---|---|---|---|
| 2135271 | 1/1973 | Fed. Rep. of Germany | 271/243 |
| 824006 | 1/1938 | France . | |
| 2041896 | 2/1971 | France . | |
| 90343 | 6/1982 | Japan . | |
| 100047 | 6/1983 | Japan . | |
| 59-173863 | 8/1984 | Japan . | |
| 190144 | 10/1984 | Japan . | |
| 1151493 | 5/1969 | United Kingdom | 271/243 |

*Primary Examiner*—David H. Bollinger

*Attorney, Agent, or Firm*—Antonelli, Terry, Stout & Kraus

[57] ABSTRACT

To adjust the posture of a sheet being conveyed, movable checker members provided adjacent to the conveyance path for the sheet are once driven in the direction of conveyance of the sheet before the members touch the sheet and are subsequently decelerated, the members being caused to abut against the front end of the sheet during the deceleration, thereby checking the sheet and thus correcting any skew thereof. Further, for positioning the sides of the sheet, the sheet is taken out of a hopper by way of a separating device and is guided and fed in such a manner that its front corner will not be caused to abut against a side registration guide, and subsequently the sheet is conveyed toward the guide by way of obliquely extending conveyer belt devices and one side of the sheet is brought into contact with the guide for positioning after a front corner of the sheet has passed at least the edge of the guide.

10 Claims, 9 Drawing Sheets

METHOD AND APPARATUS FOR ADJUSTING POSTURE OF SHEETS

BACKGROUND OF THE INVENTION

The present invention relates in general to controlling the posture of sheets being conveyed, and in particular to a method and apparatus for adjusting the posture or position of sheets being fed to a portion such as a printing station in a printer.

In such apparatus as a laser beam printer, there is a type of apparatus in which a large number of stacked sheets are held and the sheets are fed, one at a time, to a predetermined position such as a printing station. When the sheets are conveyed, they must be in a predetermined posture so that an intended operation such as printing can be performed correctly. Sheets however are prone to be brought into incorrect postures while being conveyed; for example, they may be skewed. Therefore, devices for controlling the posture of sheets being fed are used.

Japanese laid-open patent application No. 100047/1983 discloses a device including a stationary checking member which is arranged such that fed sheets will collide against the member and their skewed posture can thereby be corrected. Specifically, upon collision each sheet is brought into a posture in which its leading edge is correctly positioned, and possible skewed postures of sheets being fed may thus be corrected.

Japanese laid-open patent application No. 190144/1984 discloses another device for correcting the skewed posture of fed sheets in a manner similar to that in which the device of the previously mentioned publication does. This device further comprises a sensor for detecting the thickness of sheets, for instance, by means of transmitted light therethrough, for the purpose of achieving optimum correction of skewed posture of sheets being fed. The force acting between a checking member and a sheet colliding against the checking member is adjusted by controlling the force for conveying the sheet depending on the detected thickness of the sheet.

Further, Japanese laid-open patent application No. 90343/1982 proposes a device for registering sides of sheets being fed. The device comprises a side registration guide. Each fed sheet is once turned aside so that a front corner thereof will not collide against the guide while being conveyed, and subsequently its direction of travel is again turned so as to bring a side of the sheet into contact with the guide, thereby positioning the sheet.

Another device is also known in which a corners or a side of each sheet is directly brought into contact with a guide without being once separated therefrom in order to register the sides of the sheets.

SUMMARY OF THE INVENTION

However, the above-mentioned system including the sensor for detecting the sheet thickness and using the stationary checking member for aligning the leading edge of a sheet sometimes cannot properly control the sheet posture through the mere detection of the sheet thickness because the rigidity as well as density of the sheet, and hence the conveying force for the sheet, will vary depending on the type of the sheet.

Also, the above-mentioned device using the side registration guide has problems in that the sheet transport path becomes long and the movement of the sheet along the path is therefore complicated, or in that the sheet may be deformed off from the plane in which the sheet is conveyed, or the sheet corners may be folded.

An object of the present invention is therefore to provide a method which allows correcting any skewed posture of a sheet being conveyed without requiring the detection of the thickness thereof.

Another object of the present invention is to provide a method which allows positioning the sides of a sheet being conveyed in a short conveying path without deforming or folding the sheet.

A further object of the present invention is to provide a method which allows always properly adjusting a conveyed sheet into a predetermined posture irrespectively of the type of the sheet.

A still further object of the present invention is to provide apparatus for implementing the above-mentioned methods to be provided by the present invention.

To achieve the above objects, according to the present invention, checking members are constructed and arranged to be movable in the direction in which a sheet is conveyed so that the members are once driven before coming into contact with the sheet, subsequently decelerated, and brought to abut against the leading edge of the sheet while being decelerated. Thus, the collision of the checking member with the sheet will cause only a reduced force exerting therebetween, hardly causing a bound or buckling of the sheet, and therefore highly accurate control can be performed within a short time. In addition, since the detection of the sheet is not necessitated, malfunctioning caused by erroneous detection will not occur.

Further, according to the present invention, for the purpose of positioning the sides of a sheet, the sheet is conveyed while being guided such that its front corner cannot collide with a side registration guide, and the sheet is conveyed toward the guide so as to cause the sheet side to touch the guide after the front corner of the sheet has passed at least an edge of the guide. Thus, it is possible to securely register the side of the sheet without causing any fold at the corner of the sheet.

In one aspect of the present invention, there is provided a method of adjusting the posture of a sheet being conveyed by causing movable checking means to touch the sheet, the checking means being provided adjacent to a conveying path of the sheet the method comprising the steps of: driving the checking means in the same direction as that in which the sheet is conveyed; subsequently decelerating the checking means; and causing the checking means to abut against a leading edge of the sheet being conveyed during the deceleration of the checking means, thereby correcting any skew of the sheet.

Preferably, the method further comprises the step of detecting the sheet being conveyed, and the driving of the checking means being initiated by the detection of the sheet. Preferably, the driving of the checking means is such that the means is once accelerated to at least a conveying speed for the sheet and is subsequently driven at a constant speed for a predetermined period of time, and the deceleration of the means is effected until the checking means stops.

The present invention in another aspect provides a method of adjusting the posture of a sheet being conveyed by causing positioning means to touch a side of the sheet, the means being provided adjacent to a conveying path of the sheet, the method comprising the steps of: conveying the sheet while guiding the same in such a manner that the sheet cannot be brought into contact with the positioning means; and conveying the sheet while maintaining the same in contact with the positioning means, thereby positioning the side of the sheet, after a front corner of the sheet has passed by at least a front edge of the positioning means which faces a conveying direction for the sheet.

Preferably, the two methods are carried out in combination.

In a further aspect of the present invention, there is provided an apparatus for adjusting the posture of a sheet being conveyed, comprising: conveyer means defining a conveying path for conveying the sheet therealong; movable checking means provided adjacent to the conveying path for correcting skew of the sheet being conveyed; means for driving the checking means and for controlling movement of the checking means with the driving and controlling means controlling the checking means in such a manner that the driving and controlling means once drives and subsequently decelerates the checking means in the same direction as that in which the sheet is conveyed, and the driving and controlling means causes the checking means to abut against a leading edge of the sheet during the deceleration of the checking means so that the collision of the sheet with the checking means can be moderated.

The present invention in a further aspect provides an apparatus for adjusting the posture of a sheet being conveyed, comprising: conveyer means defining a conveying path for conveying a sheet therealong; means provided adjacent to the conveying path for positioning a side of the sheet; means for guiding the sheet such that the sheet will not be brought into contact with the positioning means; means for bringing the side of the sheet into contact with the positioning means after a front corner of the sheet has passed by a front edge of the positioning means facing the conveying direction for the sheet.

BRIEF DESCRIPTION OF THE DRAWINGS

The above and other objects, features and advantages of the present invention will be apparent from the detailed description given below with reference to the accompanying drawings and from the appended claims. In the accompanying drawings, which all show various embodiments of the present invention:

DETAILED DESCRIPTION OF THE PREFERRED EMBODIMENTS

The apparatus for adjusting the posture of a sheet according to the embodiments of the invention will now be described with reference to the accompanying drawings.

Figure 1:
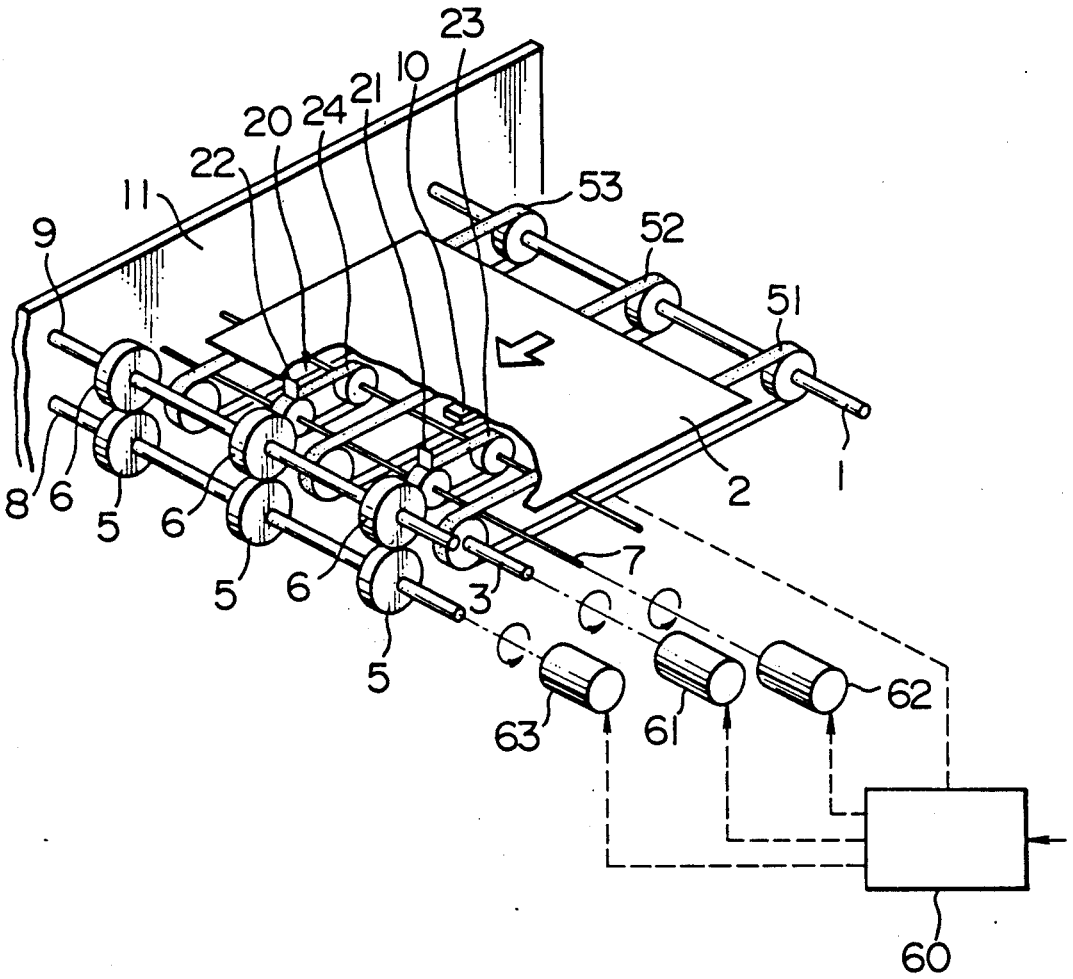
FIG. 1 is a perspective view showing the apparatus for adjusting the posture of a sheet according to an embodiment of the present invention.

FIG. 1 shows the overall arrangement of the apparatus according to an embodiment of the invention. The apparatus has a pair of substantially parallel side plates 11, only one of which is illustrated in the drawing. A conveyer belt driving shaft 3 and a driven shaft 1 are rotatably supported on the side plates. These shafts 1 and 3 have pulleys mounted thereon, on which a plurality of conveyer belts are wound. The present embodiment includes three belts 51, 52 and 53. A motor 61 connected to the conveyer belt driving shaft 3 serves to rotate the conveyer belts 51, 52 and 53. Though not shown in FIG. 1, a pile of a large number of stacked sheets 2 is mounted on a hopper adjacent to the conveyer belts. The sheets 2 are taken out of the pile, one by one, by separating means, and are sequentially transported in a spaced relation into the gap between a guide plate 12 and the conveyer belts 51, 52 and 53. With respect to the guide plate 12 and the separating means, a description will be given later.

Between the conveyer belt driving shaft 3 and conveyer belt driven shaft 1, there are provided checking members 21 and 22 for controlling the movement of the paper sheets 2, which are arranged, respectively, between the conveyer belts 51 and 52, and between 52 and 53.

The checking members 21 and 22 are fixed to checker supporting belts 23 and 24, respectively, and move together with these belts. The checking members 21 and 22 and the checking member supporting belts 23 and 24 constitute skew correcting means 20.

Though not shown in FIG. 1, the checking members 21 and 22 are also arranged in locations which bisect the checking member supporting belts 23 and 24. The checker supporting belts 23 and 24 can be rotated by an checker driving shaft 7 which is rotatably supported on the side plates 11.

An optical sensor 10, which serves to detect the presence of the paper sheet 2, is provided within the conveying path and upstream of the upstream end of the regions within which the checking members 21 and 22 can be moved, in a manner not interfering with the movement of the sheets 2. The optical sensor 10 delivers an output signal when it has detected the front end of the sheet 2, and the output signal triggers the actuation of a motor 62 connected to the checker driving shaft 7.

Downstream of the conveyer belts 51, 52 and 53 and the checking members 21 and 22, there are provided a conveyer roller shaft 8 which has conveyer rollers 5 mounted thereon, and a driven roller shaft 9 which has driven rollers 6 mounted thereon which face the conveyer rollers 5. These shafts 8 and 9 are rotatably supported on the side plate 11 and another side plate (not shown) which is situated parallel to the illustrated plate 11. The conveyer rollers 5 are driven for rotation by means of a motor 63 connected to the conveyer roller shaft 8. Control means 60, which is for controlling the speed of rotation of the motors 61, 62 and 63, will deliver control signals depending on signals from other conveyer systems, separating belts to be described, and the previously mentioned optical sensor 10.

The speeds of rotation of the motors 61 and 63 are controlled to substantially equalize the peripheral speed of each of the conveyer belts and of the conveyer rollers 5 with the conveying speed V at which the sheet 2 is conveyed.

In this embodiment, the drive shaft 3, drive roller shaft 8 and checker drive shaft 7 have individual motors connected thereto. Alternatively, a single power source may be arranged to drive, through a power transmission, all the shafts at predetermined speeds.

FIGS. 2-6 show the movement of the sheet 2 relative to the movement of the checking members 21 and 22 at sequential points of time in the embodiment.

Figure 2:
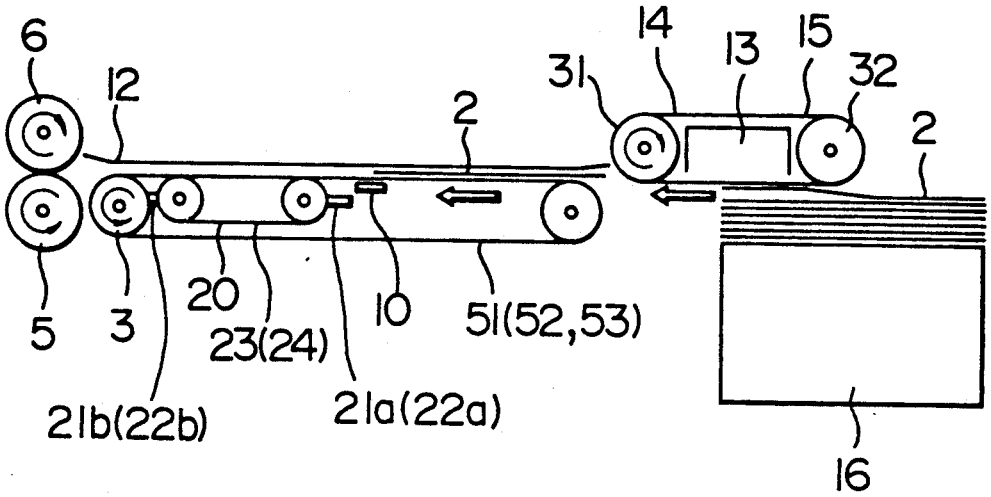
FIGS. 2–6 are schematic side views for explaining the operation of the apparatus shown in FIG. 1.

FIG. 2 shows the phase in which the sheet 2 is between separating means 15 and the optical sensor 10. The sheets 2 stacked in a hopper 16 are separated from the pile of sheets 2 and taken out of the hopper 16 one after another by the separating means 15.

The separating means 15 comprises a suction chamber 13 communicating with a vacuum suction device (not shown), and a separating belt 14 having suction ports therethrough and wound around a drive pulley 31 and a driven pulley 32. The suction ports through the separating belt 14 are intermittently brought into register with the suction chamber 13 as the belt rotates, and such register causes one sheet 2 on top of the pile of sheets 2 to be drawn to and held by the separating belt 14. The sheets 2 are thus delivered one after another onto the conveyer belts 51, 52 and 53. A guide plate 12, provided above and spaced from the conveyer belts by a constant distance, serves as a guide for preventing the sheet from rising off the belts 51, 52 and 53.

Each sheet 12 delivered to between the guide plate 12 and the conveyer belts 51, 52 and 53 is conveyed by the conveyer belts 51, 52 and 53. The optical sensor 10 will detect the front end of each sheet 2 passing by the sensor 10 and deliver a detection signal to a control circuit for controlling the driver for driving the checking members 21 and 22 for rotation. The checking members 21*a* (22*a*) and 21*b* (22*b*) are situated to bisect the checker supporting belt 23 (24).

In the condition shown, the checker members 21*a* (22*a*) and 21*b* (22*b*) are positioned below the top surface of the conveyer belts 51, 52 and 53 and remain there until the optical sensor 10 detects a sheet 2 passing thereby and the control means 60 receives a detection signal from the sensor 10.

Figure 3:
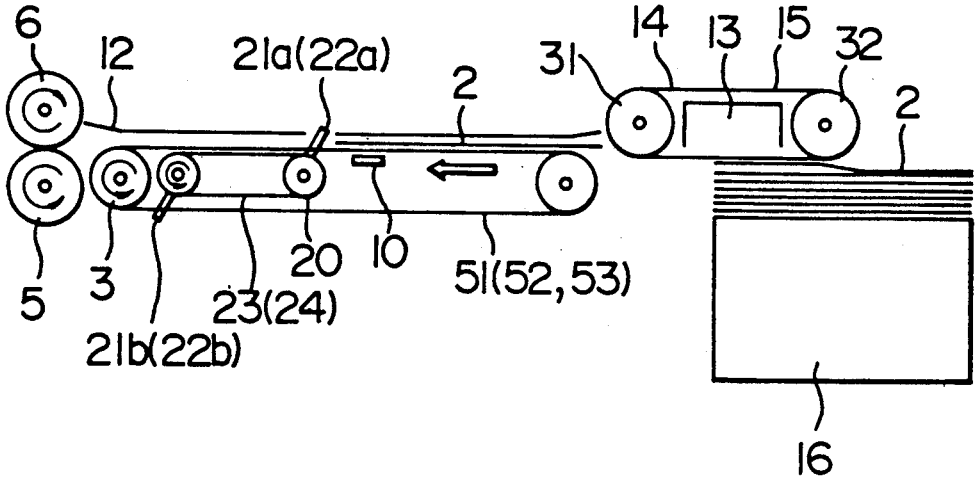

FIG. 3 shows a subsequent phase in which the optical sensor 10 detects the front end of a sheet 2 and the checker members 21*a* (22*a*) and 21*b* (22*b*) are actuated.

In response to the detection signal, a checker controlling unit of the control means 60 will actuate the checker driving shaft 7 by means of the motor 62, the checker members 21*a* (22*a*) are thus accelerated to above the top surface of the conveyer belts at a location downstream of the detected sheet 2.

Figure 4:
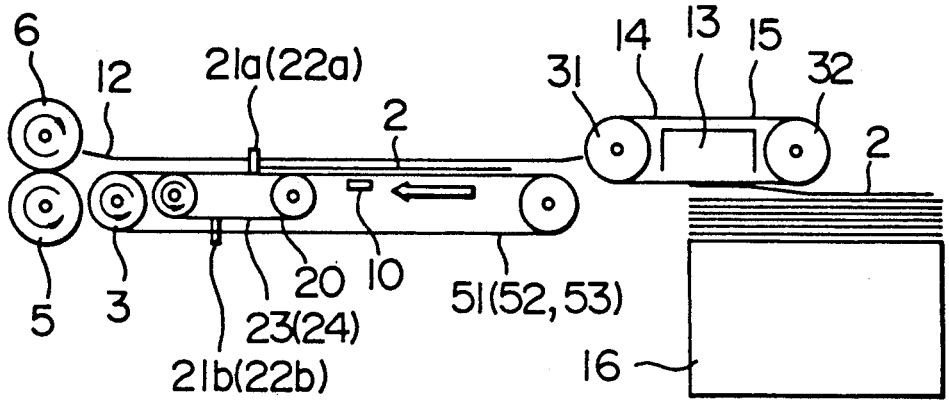

More specifically, the checker member 21*a* (22*a*) is accelerated to near the conveying speed at which the sheet is conveyed, and such member is subsequently decelerated. In the course of this deceleration, the sheet 2 comes to touch the checker 21*a* (22*a*), as shown in FIG. 4, and the sheet conveying speed V is thus dominated by the speed of the checker 21*a* (22*a*). If the sheet 2 is skewed relative to the checker 21*a* (22*a*) when they touch together, the skew of the sheet 2 is corrected by the checker members 21 and 22 which push the sheet 2 at its front end during the deceleration of the checkers 21 and 22, as shown in FIG. 4.

Figure 5:
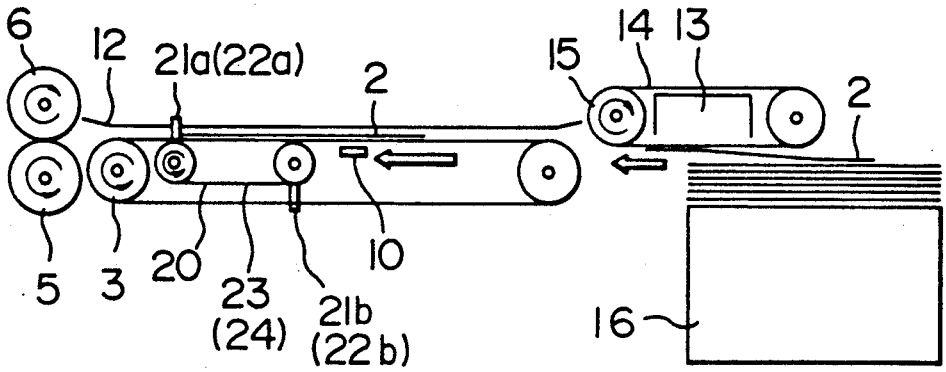

The checkers 21*a* (22*a*) is further decelerated to stop at the position shown in FIG. 5. FIG. 5 shows the sheet 2 stopped. Upon reception by the control means 60 of an open-checkers signal from a central processing unit (not shown), the checker 21*a* (22*a*) is accelerated faster than the sheet 2 and thus rotates to a waiting position shown in FIG. 2.

Figure 6:
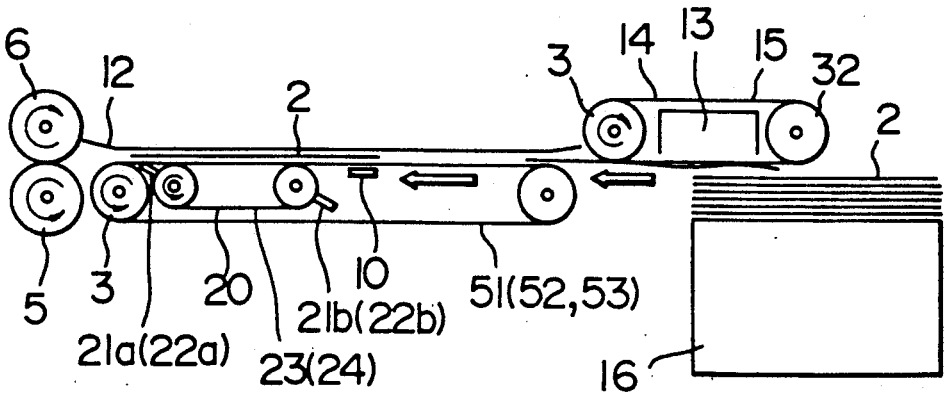

After the checker 21*a* (22*a*) has been brought out of the conveying path and thus the path has become open, the sheet 2 is conveyed by the belts 51, 52 and 53 into the nip between the conveyer roller 5 and the driven roller 6 situated downstream. FIG. 6 shows the phase in which the checker 21*a* (22*a*) is out of the conveying path.

For the following sheet 2, the other checker 21*b* (22*b*) acts in the same manner as the checker 21*a* (22*a*).

Figure 7:
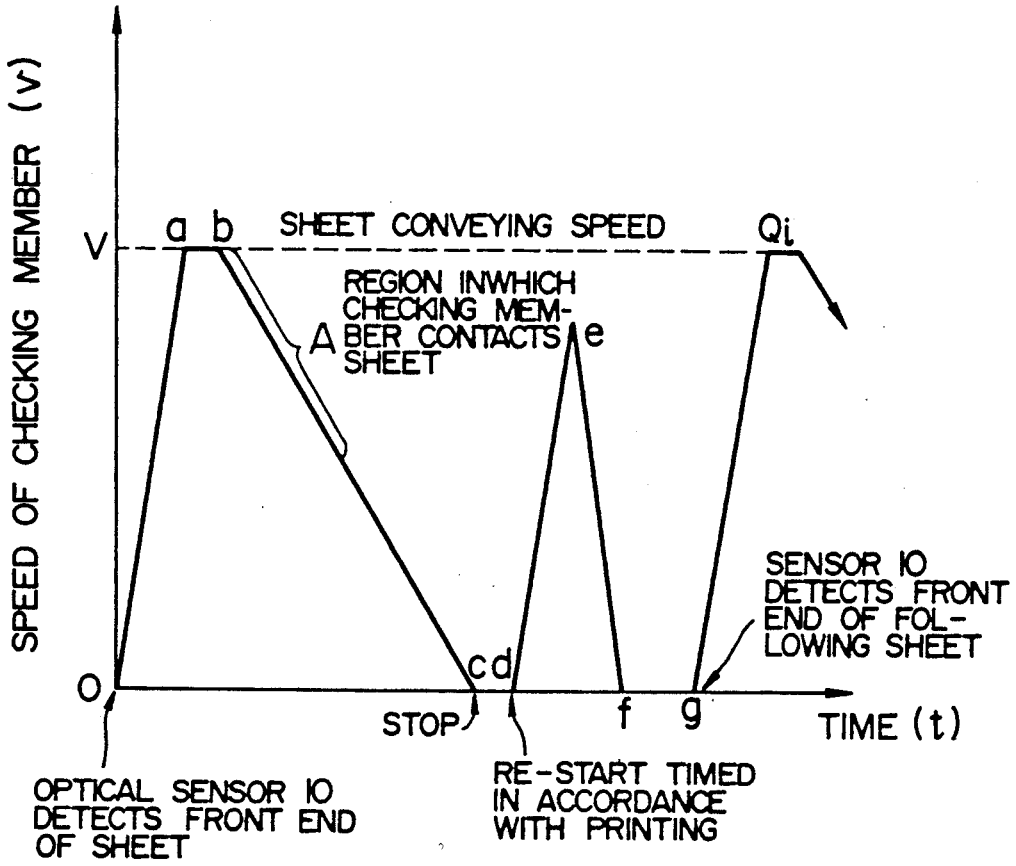
FIG. 7 is a diagram showing the driving speed of a checker member of the apparatus shown in FIG. 1.

FIG. 7 shows the movement of the checkers 21*a* (22*a*) and 21*b* (22*b*) based on the signals from the control means 60 in terms of the speed of the checkers varying with time. In this figure, time is taken along the abscissa axis and the speed V is taken along the ordinate axis.

Upon detection of the front end of each sheet 2 by the optical sensor 10, the checker drive shaft 7 is actuated for rotation (at point O) and is accelerated (between points O-a), and is subsequently driven at a constant speed near the conveying speed V at which the sheet 2 is conveyed (between points a and b).

Subsequently, the checker drive shaft 7 is gradually decelerated (between points b and c) and then stops (at point c). Thus, in the interval A between the points b and c, the checker member 21*a* (22*a*) or 21*b* (22*b*) will be brought into contact with the sheet 2 and thus the skew of the sheet 2 is corrected in a manner as described previously.

After the checker members 21*a* (22*a*) and 21*b* (22*b*) have once been stopped, the control means 60 receives a printing signal from the central processing unit at point d and the checker drive shaft 7 is accelerated between points d and e and subsequently decelerated between points e and f to stop at the waiting position. Upon detection of the following sheet 2 by the optical sensor 10, similar actions or operations are performed for such sheet 2 by the checker members 21*a* (22*a*) and 21*b* (22*b*) based on the signals from the control means 60; the checker drive shaft 7 is again started for rotation at point g, and is accelerated between points g and h and subsequently, between points h and i, it is driven at a constant speed near the conveying speed V for the sheet 2.

Figure 8:
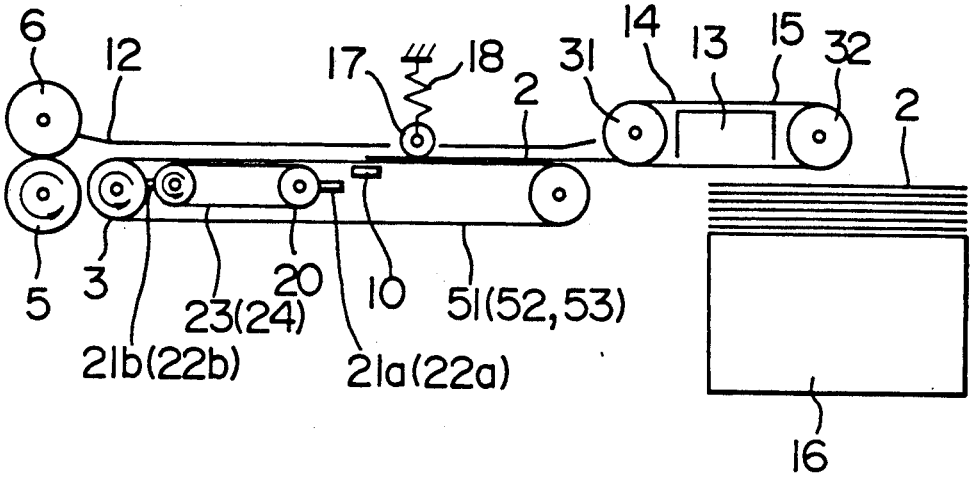
FIGS. 8 and 9 are schematic side views respectively showing apparatuses according to other embodiments of the invention.

FIG. 8 shows the apparatus according to another embodiment of the present invention. In the following description, elements identical or similar to those of the previous embodiment are designated by the same reference numerals and will not be described in detail again.

The apparatus shown in FIG. 8 has an arrangement in which a stronger force may be exerted for conveying sheets. Thus, where the conveying force acting between the conveyer belts 51, 52 and 53 and each sheet 2 is not sufficient, it is possible to enhance the conveying force by providing an auxiliary roller 17 urged by a spring 18 against the sheet conveyer, as shown in FIG. 8. Alternatively, in place of the auxiliary roller 17, the guide plate may be pressed against the conveyer belts 51, 52 and 53 by a constant pressing force to enhance the conveying force acting between the sheet 2 and the conveyer belts 51, 52 and 53.

Figure 9:
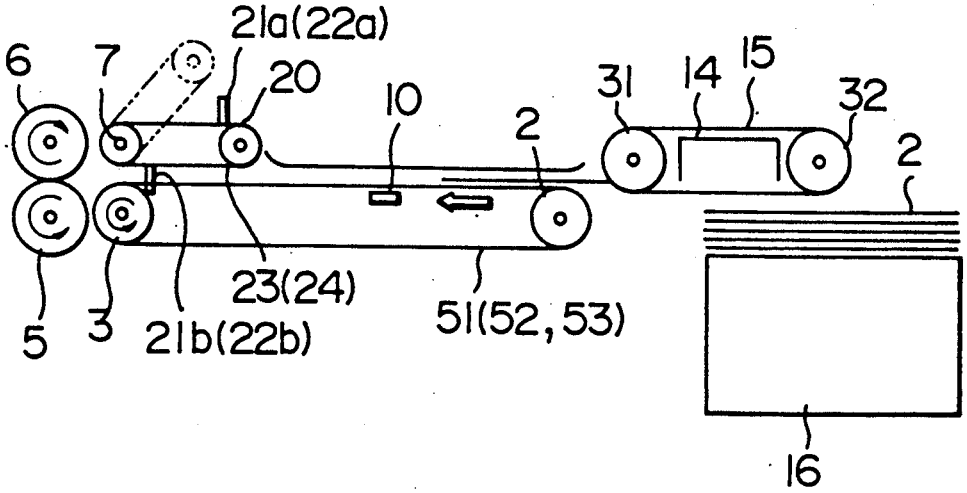

FIG. 9 shows the apparatus according to a further embodiment of the present invention.

In this embodiment, skew correcting means 20 is arranged opposite to the top surface of the conveying path of the conveyer means. The skew correcting means 20, like that of the previously described embodiments, can be rotated about the drive shaft 7.

Thus, during operation, the checker member 21*a* (22*a*) or 21*b* (22*b*) may be caused to project into the conveying path. If the sheet 2 is jammed, for example, in the conveying path, the skew correcting means 20 can be rotated about the drive shaft 7. This makes it possible to easily remove the jammed sheet 2 from the conveying path.

In the above described embodiments, the conveying means comprises three conveyer belts, between which two checker supporting belts are arranged with checker members secured thereto. However, the number of the checker supporting belts is not limited to two and any plurality of supporting belts having checker members secured thereto may be provided. Also, the number of the conveyer belts is not limited to three. Further rollers can be used in place of the conveyer belts.

The means for separating and taking sheets from the hopper one after another is not limited to the previously described means which comprises the suction chamber and the separating belt having the suction ports therethrough. Any means can be used as long as it can separate and take sheets out of the hopper one after another. For example, friction rollers may be used.

The above described embodiments are arranged so that each sheet being conveyed can be gradually checked. Therefore, they may be applicable to paper sheets of a wide range of thickness and make it possible to correct skew of the paper sheets accurately and within a short period of time.

Also, these embodiments make it possible to correct skew of paper sheets while securely conveying them one sheet at a time, achieving efficient conveyance of paper sheets.

Next, the apparatus for adjusting the posture of paper sheets according to a further embodiment of the invention will be described with reference to FIGS. 10–14. This embodiment is for registering the sides of sheets being conveyed.

Figure 10:
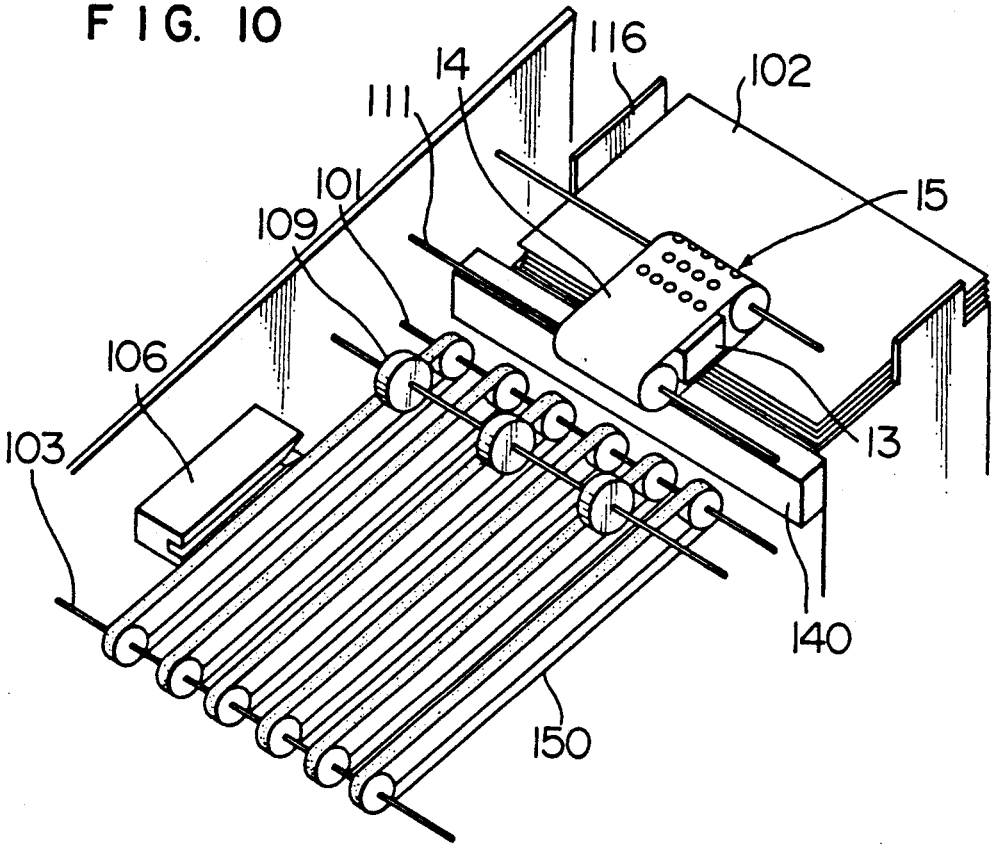
FIG. 10 is a perspective view showing the apparatus according to a further embodiment of the invention.

Referring to FIG. 10, there are shown sheets 102 stacked on a hopper 116 fixed to side plates 111 of the apparatus. The hopper 116 is provided with an elevator mechanism (not shown) for vertically moving the stacked sheets 102.

In front of the hopper 116, there is provided a compressed air chamber 140, which is adapted to blow an air jet up to the stacked sheets 102, thus making it easier to separate the sheets 102 on the hopper 116 from one another. Thus, the topmost one of the stacked sheets 102 is somewhat raised off from the underlying sheets and can be easily drawn by the separating means 15. The separator 15, like the one of the previously described embodiments, comprises the suction chamber 13 and the suction-ported belt 14 wound around driving and driven pulleys.

In front of the separating station, a plurality of conveyer belts 150 are wound around pulleys which are mounted on a driving shaft 103 and a driven shaft 101. A side registration guide 160 is mounted to one of the side plates 111, and the conveyer belts 150 are arranged to extend obliquely so as to gradually near the guide 160.

The side registration guide 160 has a groove formed in a side thereof which faces the sheet conveying path. The groove lies in the plane in which sheets are conveyed. The guide is positioned so that each sheet 102 being conveyed in the plane is brought into contact with the guide 160 at the groove surface.

Over the conveyer belts 150, there are rotatably provided overlap rollers 109 for conveying sheets 102. These overlap rollers 109 are situated at a position where the conveying force provided by the separating means on each sheet substantially disappear or reduces. Therefore, each separated sheet 102 can be moved smoothly a short distance from the separating station to the side registering station.

Each sheet 102 is fed along the conveyer belts 150 and obliquely toward the guide 160 after it has passed the overlap rollers 109. The sheet 102 is then guided into the groove in the side registration guide 160.

Figure 11:
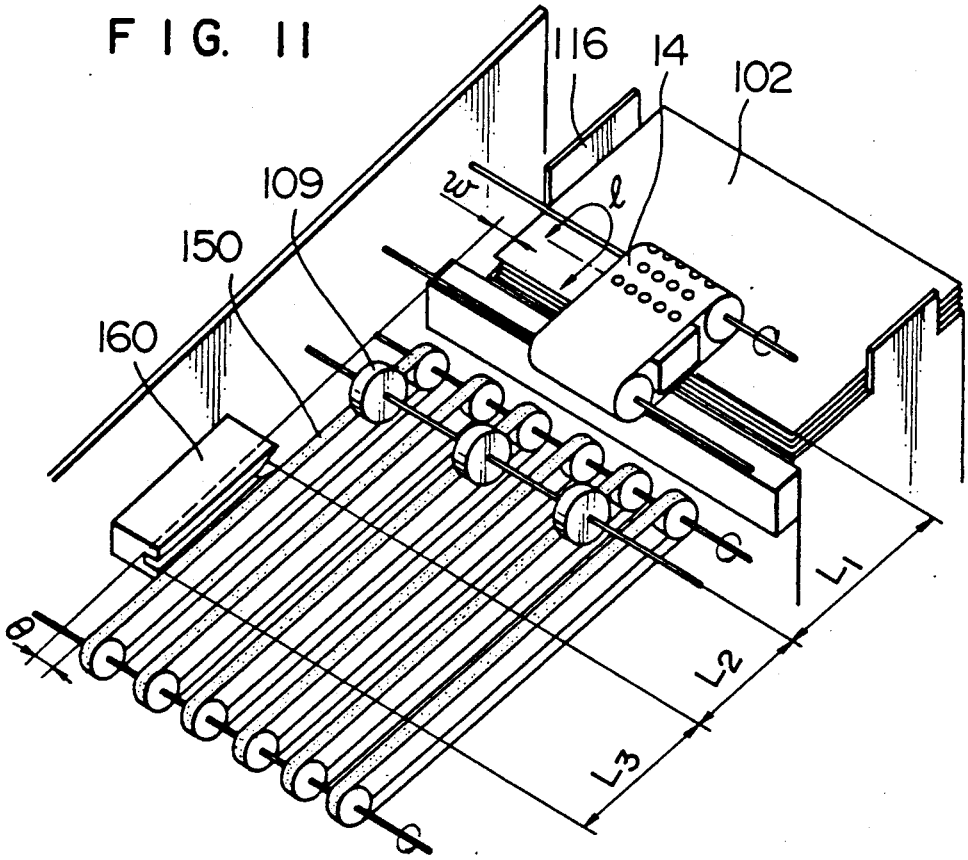
FIG. 11 is a perspective view for explaining the relative position of various elements of the apparatus shown in FIG. 10.

Relative positions of the components of the above apparatus will be described with reference to FIG. 11. Assuming here that the distance from the front ends of the sheets 102 contained in the hopper 116 to the overlap rollers 109 is $L_1$, the distance from the overlap rollers 109 to the side registration guide 160 is $L_2$, and the length of the side registration guide 160 is $L_3$. Further, the skew angle of the conveyer belts is assumed to be $\theta$, and the length of the separating belt 14 in which the suction ports are provided is assumed to be l. It is further assumed that the distance from the sheet guiding plane of the side registration guide 160 to the corresponding side of each sheet 102 in the hopper 116, which faces the sheet guiding plane of the guide 160 is w.

The sheet is conveyed while approaching the side registration guide 160 by the obliquely extending conveyer belts 150 and the overlap rollers 109 after it has reached the overlap rollers 109. Until the sheet reaches the overlap rollers 109, it must be fed by the separating belt 14. Therefore, the following relation must hold:

$$L_1 \geqq l \tag{1}$$

In order to avoid collision of a corner of the sheet 102 with the side registration guide 160, the following relation:

$$w \geqq (L_2+L_3)\cdot\tan\theta \tag{2}$$

must hold with respect to the position of the sheets in the hopper 116 relative to the side registration guide 160.

In order that the sheet 102 can be securely brought into contact with the side registration guide 160 and so that the side registration of the sheet can be securely performed, the relation:

$$w \leqq (L_2+L_3+L_p)\cdot\tan\theta \tag{3}$$

must hold, where $L_p$ represents the length of the sheet as measured in the direction of conveyance.

From the above relations (2) and (3), the expression:

$$(L_2+L_3)\cdot\tan\theta \leqq w \leqq (L_2+L_3+L_p)\cdot\tan\theta \tag{4}$$

can be obtained.

The expression (4) is also applicable to apparatuses employing frictional separation means in place of the suction type separator.

Figure 12:
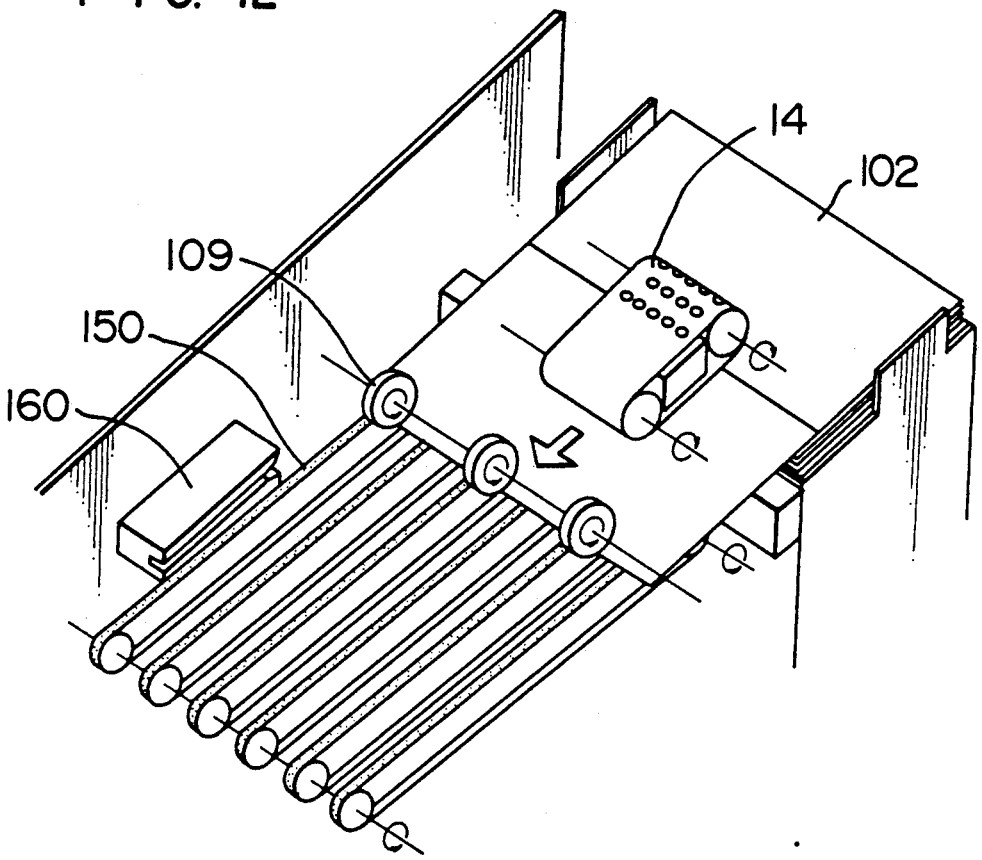
FIGS. 12–14 are perspective views for explaining the operation of the apparatus shown in FIG. 10.
Figure 13:
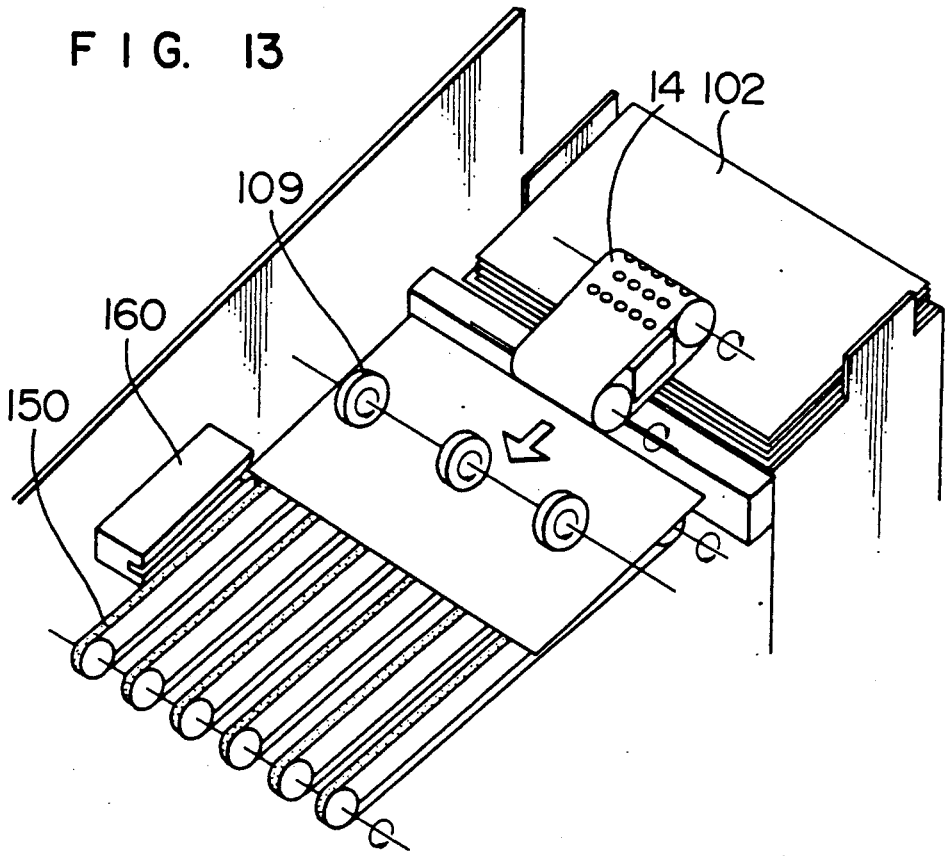
Figure 14:
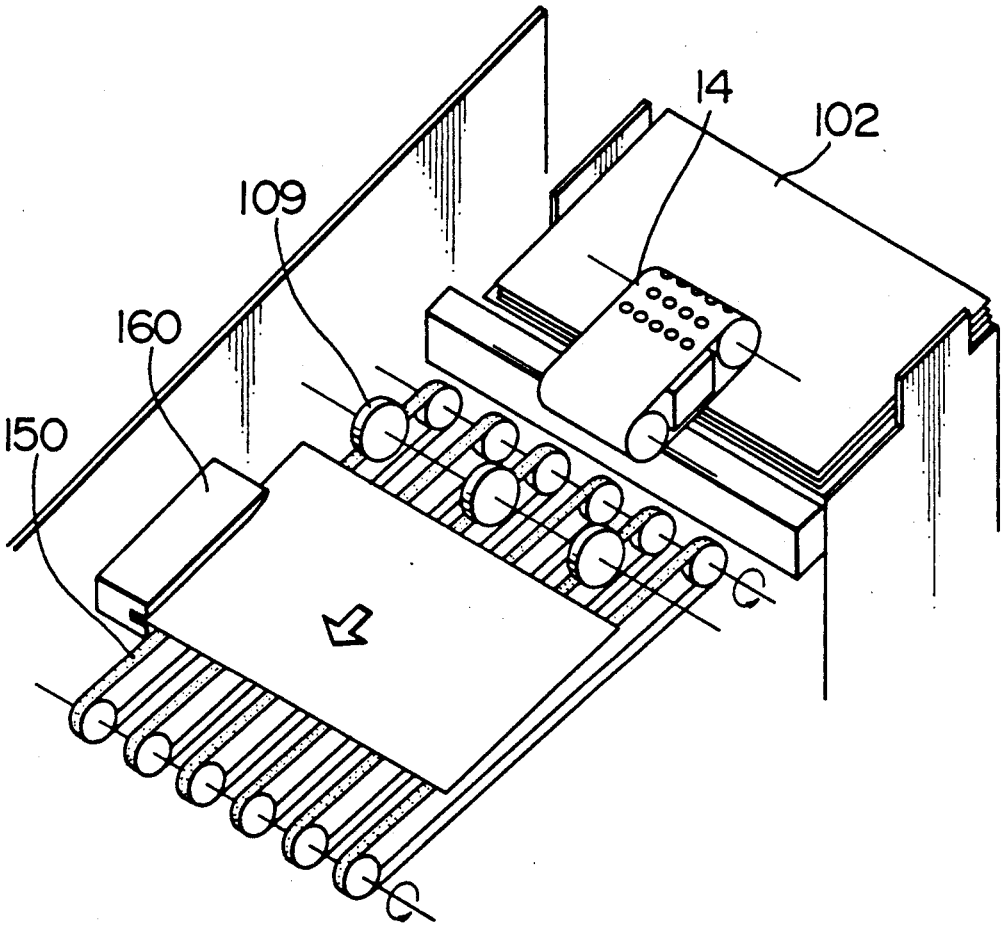

Referring to FIGS. 12–14, the behavior of the sheet 102 in the above described embodiment will be explained.

FIG. 12 shows the sheet 102 which is drawn to, thus separated by the separating belt 14 and conveyed to the overlap rollers 109. The sheet 102 is moved straight until it reaches the overlap rollers 109, since it is drawn by vacuum to the separating belt 14.

When the sheet has reached the overlap rollers 109, the sheet drawing action of the separating belt 14 is reduced. Thereafter, the conveying force provided by the overlap rollers 109 and the conveyer belts 150 becomes predominant.

FIG. 13 shows the sheet 102 being conveyed obliquely. In this condition, however, the front corner of the sheet 102 will not collide with the side registration guide 160.

FIG. 14 shows the sheet 102 being conveyed with its front end passing through the groove of the side registration guide 160. The front end corner of the sheet will not collide with the side registration guide 160. After the front end of the sheet has passed the side registration guide 160, one side of the sheet 102 is brought into contact with the groove of the guide 160, whereby the side registration of the sheet is performed.

The above described embodiment can perform a high precision side registration of sheets in a short conveying path without causing folds of the sheets at the corners thereof or jamming thereof. Therefore, they have an advantage in that printing on a preprinted paper sheet or on the entire surface of a sheet can be performed in a compact arrangement of the embodiment.

Figure 15:
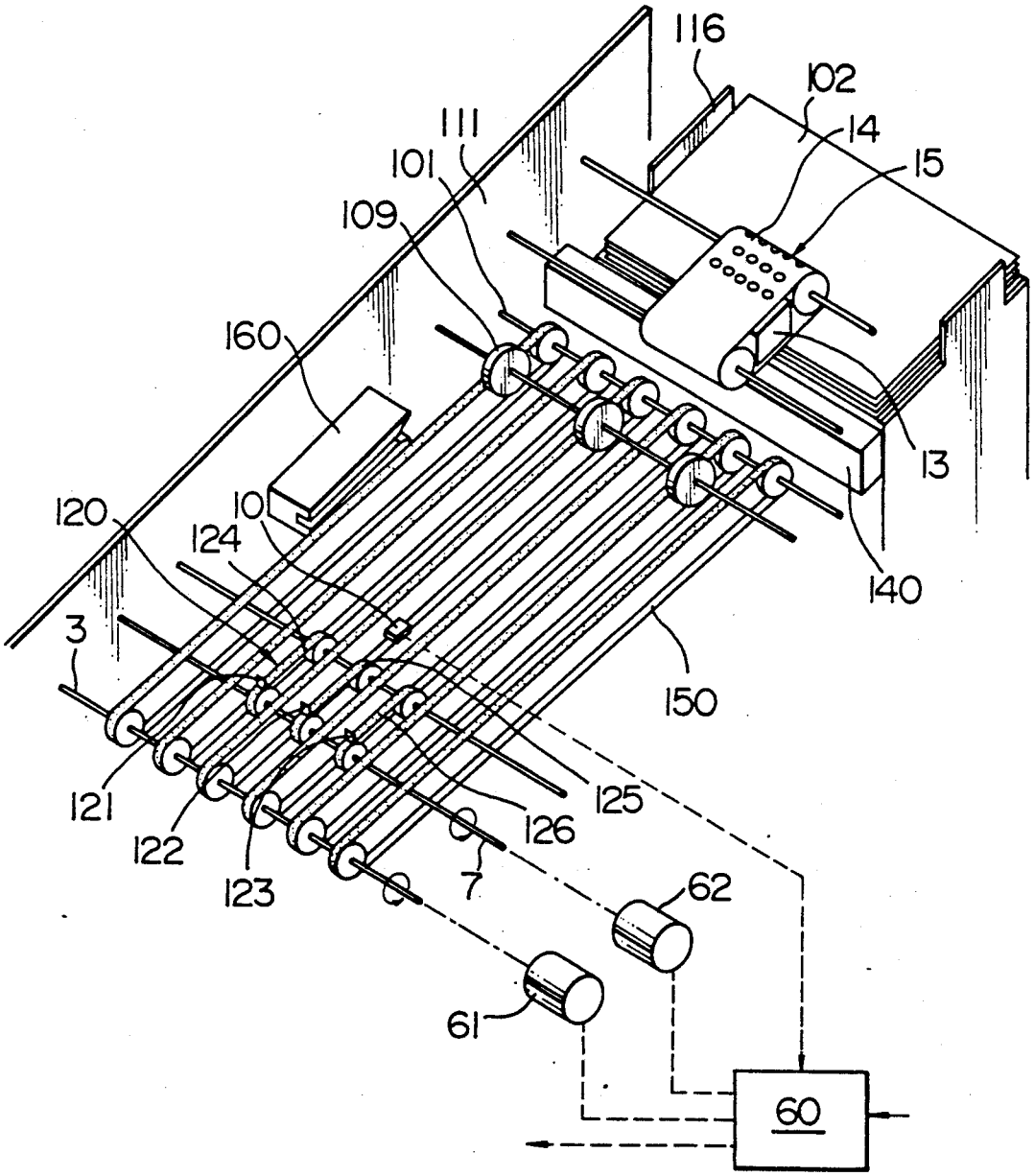
FIG. 15 is a perspective view showing the apparatus for adjusting the posture of a sheet according to still another embodiment of the invention.

FIG. 15 shows the apparatus according to still another embodiment of the present invention. The apparatus shown is a combination of the embodiments shown in FIG. 1 and FIG. 10 and the components of this apparatus are similarly arranged except that the skew correcting means includes three sets of checker members. The skew correcting means 120 comprises three sets of checker supporting belts 124, 125 and 126 which respectively have checker members 121, 122 and 123 secured thereto and will operate in the same manner as those of FIG. 1 embodiment does.

In operation of the present embodiment, each sheet 102 is side registered by the side registration guide 160 and subsequently comes into contact with the checker members 121, 122 and 123, whereby the sheet is checked at a predetermined position. Thus, in accordance with the present embodiment, not only the skew correction of the sheet 102 during conveyance but also the side registration thereof can be performed and thus it is always possible to properly adjust the posture of sheets being conveyed.

The invention has been described with reference to the drawings showing various embodiments. It should be appreciated, however, that the invention is not limited to the specific arrangements of these embodiments, and is susceptible to various modifications or variations within the scope of the appended claims.

What is claimed is:

1. A method of adjusting posture of a sheet being conveyed in a conveyance path by bringing movable checker means for correcting skew of the sheet into contact with the sheet, said checker means being provided adjacent to the conveyance path, and said method comprising the steps of:

detecting presence of the sheet being conveyed;

driving said checker means in the same direction as a direction in which said sheet is being conveyed, said driving of said checker means being initiated upon the detection of the sheet; and decelerating said checker means and bringing said checker means into contact with a front end of said sheet being conveyed during the deceleration of said checker means, thereby correcting any skew of the sheet;

wherein:

said checker means is driven at least up to a speed at which said sheet is being conveyed, and subsequently said checker means is driven at a constant speed for a predetermined period of time, and then said deceleration is performed until said checker means stops.

2. A method according to claim 1, wherein a positioning means is provided adjacent to said conveyance path, and said method further comprises the steps of:

guiding the sheet being conveyed such that the sheet is not brought into contact with said positioning means; and bringing the sheet being conveyed into contact with said positioning means after a front corner of said sheet has passed said positioning means, thereby positioning sides of said sheet.

3. A method according to claim 2, wherein said positioning means is provided adjacent to said conveyance path on an upstream side of said checker means with respect to the direction of conveyance of said sheet.

4. An apparatus for adjusting posture of a sheet being conveyed, comprising:

conveyor means defining a conveying path for conveying a sheet along the path;

movable checking means provided adjacent to the conveying path for correcting skew of said sheet being conveyed;

means for driving said checking means and for controlling movement thereof, said driving and controlling means controlling said checking means in such a manner that said driving and controlling means drives and subsequently decelerates said checking means in the same direction as a direction in which said sheet is conveyed, and said driving and controlling means causes said checking means to abut against a leading edge of said sheet during the deceleration of said checking means so that collision of said sheet with said checking means can be moderated; and means for detecting said sheet being conveyed, said detecting means being connected to said driving and controlling means, and said driving and controlling means initiating the driving of said checking means upon detection of said sheet by said detecting means;

wherein:

said driving and controlling means accelerates said checking means at least to a speed of conveyance of said sheet, and subsequently drives said checking means at a constant speed for a predetermined period of time, and then decelerates said checking means until said checking means stops.

5. An apparatus according to claim 4, wherein said checking means includes at least one checker means which is movable between a first position in which said member projects into the conveyance path so that said member can abut against a front end of said sheet, and a second position in which said member is situated outside the conveyance path.

6. An apparatus according to claim 4, wherein said conveyer means comprises a plurality of conveyer belt devices, and said checking means comprises at least one supporting belt device movable parallel to and between adjacent conveyor belt devices, and at least one checker member fixed to said supporting belt device in such a manner that said checking member can come into and out of the conveyance path.

7. An apparatus according to claim 4, wherein said conveyer means comprises a plurality of conveyer belt devices, and said checking means comprises at least one supporting belt device provided over said conveyer belt devices ad movable parallel to said conveyer belt devices, and at least one checking member fixed onto said supporting belt device in such a manner that said checking member can come into and out of the conveyance path.

8. An apparatus according to claim 4, further comprising:

means provided adjacent to the conveyance path for positioning sides of said sheet being conveyed;

means for guiding said sheet such that the sheet is not brought into contact with said positioning means; and contact means for bringing one of side of said sheet into contact with said positioning means after a front corner of said sheet has passed said positioning means.

9. An apparatus according to claim 8, wherein said contact means is provided at a position where guiding of said sheet by said guiding means substantially terminates.

10. An apparatus according to claim 8, wherein said positioning means has a guide member arranged on one side of the conveyance path, said conveyer means includes a plurality of conveyer belt devices extending obliquely relative to said guiding member such that said sheet is moved toward said positioning means while being conveyed, said guiding means includes means for feeding said sheet onto said conveyor belt devices, and said contact means has at least one rotatable roller device arranged to cooperate with said conveyer belt devices for applying a conveying force of said conveyer belt devices to said sheet, said roller device being provided at a position where a feeding force of said feeding means substantially ceases to act on said sheet.

* * * * *